US006133439A

United States Patent [19]

Buchanan et al.

[11] Patent Number: 6,133,439

[45] Date of Patent: Oct. 17, 2000

[54] ENVIRONMENTALLY NON-PERSISTANT CELLULOSE ESTER FIBERS

[75] Inventors: Charles M. Buchanan, Bluff City; Robert M. Gardner, Gray; James E. Harris, Kingsport; Gether Irick, Jr., Gray; David V. Strickler, Jr., Kingsport, all of Tenn.

[73] Assignee: Eastman Chemical Company, Kingsport, Tenn.

[21] Appl. No.: 09/312,401

[22] Filed: May 14, 1999

Related U.S. Application Data

[63] Continuation of application No. 08/692,638, Aug. 5, 1996, abandoned, which is a continuation of application No. 07/889,213, May 27, 1992, abandoned.

[51] Int. Cl.[7] ..... C08B 3/00; C08B 5/00

[52] U.S. Cl. ..... 536/32; 524/38; 524/39; 524/41

[58] Field of Search ..... 536/32; 524/38, 524/39, 41

[56] References Cited

U.S. PATENT DOCUMENTS

| | | | |
|---|---|---|---|
| 2,794,239 | 6/1957 | Crawford et al. | 28/81 |
| 3,561,968 | 2/1971 | Damtro | 96/88 |
| 3,709,984 | 1/1973 | Damtro | 423/610 |
| 4,022,632 | 5/1977 | Newland et al. . | |

FOREIGN PATENT DOCUMENTS 1073581 8/1980 Canada .

OTHER PUBLICATIONS

American Chemical Society, 1981, Effect of Metal Salts on the Photoactivity of Titanium Dioxide, Irick, Jr. et al, 147–162.

Journal of Polymer Science: Part A: Polymer Chemistry, vol. 25, 2799–2812 (1987) Lacoste et al, $TiO_2$–, ZnO–, and Cds–Photo–catalyzed Oxidation of Ethylene–Propylene Thermoplastic Elasto.

American Chemical Society, 1981, The Chemical Nature of chalking in the Presence of Titanium Dioxide Pigments, Volz et al, 163–182.

Polymer Photochemistry 2 (1982) 457–474, Photoinitiated Chemico–Mechanial Damage of Triacetylcellulose, Mikheyev et al.

Rev. Macromlo. Chem. Phys., 1983, 22, 225–260, Kumar et al.

Journal of Applied Bacteriology, 1986, 61, 225–223, Stutzenberger et al.

Journal of Coating Technology, 1990, 62, 37–42, Juergen H. Braun.

Efffect of Photo– and Photo–Oxidative Degradation on the Light–fastness of Antimicrobial Cellulose Acetate Fiber, Paulauskas et al, Cellulose Chem. Tech. 7, 4, 417–424, Jul./Aug. 1973.

Agric. Biol. Chem., 42 (5), 1071–1072, 1978, Tokiwa et al.

Paulauskas et al, Khim. I. Khim. Tekhnol., 13, No. 7. 1062–1063 (1970). (Russian Journal).

A Contribution to the Understanding of the Light Damage to Cellulose by Delustering Pigments ($TiO_2$), Lang et al, Reyon Zellwalle und Andere Chemiefasern 3, No. 6, 383–385 (1955).

Paper Chem. No. 55–06161, (1991), "Synthesis and Properties of Photosensitive Derivatives of Cellulose".

Paper Chem. No. 53–11246 (1991), Polymer Photochem. 2, No. 6: 457–474.

Paper Chem. No. 51–03385 (1991), Photo–Aging Stabilization of Cellulose Acetate.

Paper Chem. No. 51–00049(1991), Photo– and Thermo–Oxidative Resistance of Modified Cellulose Acetate.

Derwent Accession No. 92–111 669, Questel Telesystems (WPIL), Derwent Publications Ltd., London, Abstract & JP–A–058 876 (Daicel Chem. Ind. K.K) Feb. 25, 1992.

Derwent Accession No. 82–83 173E, Questel Telesystems (WPIL), Derwent Publications, Ltd., London, Abstract & JP–A–57–055 940 (Daicel Chem. Inds. Ltd.) Apr. 3, 1982.

*Primary Examiner*—Nathan M. Nutter

*Attorney, Agent, or Firm*—Cheryl J. Tubach; Harry J. Gwinnell

[57] ABSTRACT

This invention provides cellulose ester fibers having an intermediate degree of substitution per anhydroglucose unit (DS/AGU) along with pigments which act as photooxidation catalyst. The fibers are useful as filler materials for tobacco products. The filter materials thus provided are easily dispersible and biodegradable and do not persist in the environment.

23 Claims, 10 Drawing Sheets

ENVIRONMENTALLY NON-PERSISTANT CELLULOSE ESTER FIBERS

REFERENCE TO RELATED APPLICATION

This application is a continuation of application Ser. No. 08/692,638 filed Aug. 5, 1996 now abandoned which is a file-wrapper-continuation of application Ser. No. 07/889,213 filed May 27,1992 now abandoned.

FIELD OF THE INVENTION

This invention relates to cellulose ester fibers. In particular, this invention relates to cellulose ester fibers that are useful as tobacco smoke filters.

BACKGROUND OF THE INVENTION

Due to a growing environmental awareness worldwide, the concept of product stewardship is rapidly becoming a reality for many manufacturing companies. It is no longer considered acceptable to be concerned only with the environmental consequences of a particular manufacturing process or the hazards associated with a particular chemical. Increasingly, industry is recognizing that public opinion dictates that they be held accountable for the environmental fate of their products after their intended function is complete. At the moment the need to be responsible product stewards is primarily driven by a response to public perception, but it is not at all unreasonable to envision that public opinion will soon be replaced by legal mandates.

The technical difficulties associated with being a responsible product steward are extremely complex. The chemical industry is being asked to both provide products with the performance characteristics that the public has grown to expect, and also products which will not persist in the environment. Viewed from current polymer technology, these product requirements are often mutually exclusive. Thus far, the response of individual chemical companies has been largely configured around their existing product streams. For producers of commodity goods, such as plastics used in packaging, the focus has been mainly on recycling. However, it is becoming increasingly apparent that for many disposable items, recycling or incineration do not represent feasible options. Cigarette filters are a classic example of a product type for which it would be extremely difficult to design and implement an effective collection and recycling or disposal program. Discarded cigarette filters represent a significant surface litter problem, even in areas where proper disposal receptacles are conveniently available. Thus, there is a critical market need for biodegradable materials that will not persist in the environment.

The term "biodegradable" is becoming an increasingly popular label for manufacturers to place on their products. Unfortunately, its application in many cases is inaccurate and misleading. As a direct result of the unregulated use of this term, environmental groups and the public have generally come to distrust a manufacturer's claims regarding biodegradable commodities. This situation is further augmented by the total lack of standards or legal mandates dealing with biodegradable polymers (Donnelly, J. 1990. *Garbage*, June:42–47). For the purpose of this invention, a precise definition of "biodegradable polymer" is provided in order to prevent any possible misinterpretations.

First and foremost, biodegradation is a biologically mediated process; it thus requires the direct interaction of microorganisms and/or their enzymes with the polymeric substrate. Without a biological component, use of the term "biodegradable" is a misnomer. Polymer biodegradation typically begins with a series of microbial catalyzed chain cleavage steps producing lower molecular weight fragments. These fragments are then further metabolized to short chains or monomers, which can be assimilated by the microbes and used as sources of carbon and energy. Obviously, as the degradation process continues, significant physical changes in the native polymer become apparent. Traditionally changes in physical characteristics, such as tensile strength, have been used as the sole criteria for evaluating the inherent biodegradability of a polymer. However, the most stringent requisite for determining biodegradability is total mineralization of the polymeric carbon to $CO_2$ and $H_2O$. In other words, a quantitative transfer of carbon from the polymeric chain to microbial biomass and/or their metabolic end products has to take place—with no persistent (non-biodegradable) residues. Under aerobic conditions, the metabolic path to mineralization is usually direct. In contrast, anaerobic metabolic systems typically produce metabolic end products such as methane and volatile fatty acids. These components are also non-persistent and will eventually be converted into $CO_2$ by means of less direct microbial systems.

The term "biodegradable polymer" as defined above automatically eliminates many products that merely undergo particle size reduction but yield persistent residues. For example, starch polyethylene blends have been commercially sold as biodegradable products. In actuality, only the non-sequestered starch is biodegradable. Even though microbial metabolism of the available starch is responsible for significant particle size reduction, the ultimate fate of these particles has to be taken into consideration. Both the polyethylene and the sequestered starch are recalcitrant to microbial enzymes, which means they will persist in the environment, negating the manufacturer's claim of biodegradable (Donnelly, J. 1990. *Garbage*, June:42–47).

In addition to the degradation potential of the polymeric substrate, other important chemical and physical requirements of the microorganisms must be met in order for successful biodegradation to occur (Glenn, J. 1989. *Biocycle*, October:28–32). Microorganisms represent an extremely diverse group, having adapted to a vast array of environmental extremes. However, all cells have obligate requirements before they are able to survive and grow. Examples include suitable pH, temperature, ionic strength, the proper oxygen concentrations (or the lack of oxygen for anaerobic species), available macro and trace nutrients, and appropriate moisture levels. The exact requirements will obviously vary with different species. It is important to highlight that the term biodegradable is not a universal constant that applies equally to all situations and under all environmental conditions. One only has to consider the poor performance of highly biodegradable materials in a typical landfill setting to fully appreciate this point (Donnelly, J. 1990. *Garbage*, June:42–47). This fact is often overlooked when examining the poor performance of inherently biodegradable materials in sub-optimal environments. If a compound biodegrades when placed in a suitable environment, this potential does not disappear when it is placed in a different environment, only the rate at which it degrades will change.

Numerous studies have demonstrated that cellulose or cellulose derivatives with a low degree of substitution (DS), i.e., less than one, are biodegradable. Cellulose is degraded in the environment by both anaerobic and aerobic microorganisms. Typical end products of this microbial degradation include cell biomass, methane (anaerobic only), carbon dioxide, water, and other fermentation products. The ultimate end products will depend upon the type of environment as well as the type of microbial population that is present. However, it has been reported that cellulose esters with a DS greater than about one are completely resistant to attack by microorganisms. For example, Stutzenberger and Kahler (*J. Appl. Bacteriology*, 66, 225 (1986)) have reported that cellulose acetate is extremely recalcitrant to attack by *Thermomonospora curvata*.

It is well-known in the art that cellulose esters such as cellulose acetate (CA) are widely used in applications such as cigarette filters. The CA fibers used in cigarette filters and other applications typically contain finely ground pigments at concentrations ranging from 0.5–2.0% (wt/wt). These pigments are added to CA fibers to provide opacity, thus acting as a delusterant or whitening agent. An example of such pigments is titanium dioxide. Generally, two crystalline forms of $TiO_2$, Rutile and Anatase, are used in the production of CA fibers and the choice depends upon the specific properties desired. In addition to their difference in their crystalline forms, Rutile and Anatase also differ in their specific gravity, refractive index, and hardness as well. Rutile is inherently harder and more abrasive than Anatase because of its higher degree of crystallinity. Hardness is of particular concern because of abrasion which decreases the lifetime of the equipment used to manufacture the fiber. In order to decrease the abrasion of the $TiO_2$, other materials such as $SiO_2$, $Al_2O_3$, and $Sb_2O_3$ are generally used to coat the titanium dioxide. These coatings also improve dispersion of $TiO_2$ in CA polymers. Furthermore, coating the surface of the $TiO_2$ decreases the photoreactivity of the $TiO_2$ thereby lowering the susceptibility of fibers to ultraviolet light which significantly lowers the amount of photodegradation of the fibers on exposure to sunlight (Braun, J. H. *J. Coating Technology* 1990, 62, 37.).

The steps involved in the manufacturing of cigarette filters is well known to those skilled in the art and is described, for example, by R. T. Crawford, et al. in U.S. Pat. No. 2,794,239 (1957), incorporated herein by reference. Typically, cigarette filters are elongated rods, substantially the size of a cigarette in diameter and circumference, composed primarily of crimped fibers, e.g., cellulose acetate, which are oriented in such a manner that substantially no channels are present which will permit the passage of unfiltered tobacco smoke. The fiber bundle is typically contained within a paper shell or wrapper where the paper is lapped over itself and is held together by a heat sealable adhesive; the adhesive is typically water insoluble. While it is not necessary to use plasticized fiber in forming the filter rods, in practice 2 to 15% plasticizer, e.g., dibutyl phthalate, tripropionin, triethylene glycol diacetate, triacetin, or a mixture thereof are typically applied by either spraying to the surface of the fiber by centrifugal force from a rotating drum apparatus, or by an immersion bath in order to bond the fibers together and to impart additional firmness to the rod. It should be recognized that these plasticizers are water insoluble. Thus, when the used cigarette filter is discarded as surface litter, the fibers of the filter do not disperse which inhibits photochemical or biological degradation.

There exists in the marketplace the need for fibers which would not persist in the environment and which could be used in applications for disposable items such as cigarette filters, agricultural canvas mulch, bandages, infant diapers, sanitary napkins, fishing line, fishing nets, and the like. Moreover, there exists in the marketplace the need for a cigarette filter that, when exposed to a substantial amount of water, will disperse in the environment due to the water solubility of the adhesive, plasticizer, or bonding agent binding the paper wrapper and fibers, respectively, together.

SUMMARY OF THE INVENTION

The present invention provides the combined use of cellulose esters having an intermediate degree of substitution per anhydroglucose unit (DS/AGU) with pigments which act as photooxidation catalysts to accelerate the rate of decomposition of cellulose ester to produce fibers which are non-persistent in the environment. More specifically, the invention is directed to a $C_1$–$C_{10}$ ester of cellulose having a DS/AGU of about 1.5 to 2.7 and an inherent viscosity of about 0.2 to about 3.0 deciliters/gram as measured at a temperature of 25° C. for a 0.5 g sample in 100 ml of a 60/40 parts by weight solution of phenol/tetrachloroethane. This cellulose ester is used in conjunction with 0.1–5% (w/w) of a photoactive metal to prepare fibers that are non-persistent in the environment. The cellulose ester fiber compositions provided by the present invention are to varying degrees biodegradable as defined above. This biodegradability is illustrated by the experimental section below.

DETAILED DESCRIPTION OF THE INVENTION

Figure 1:
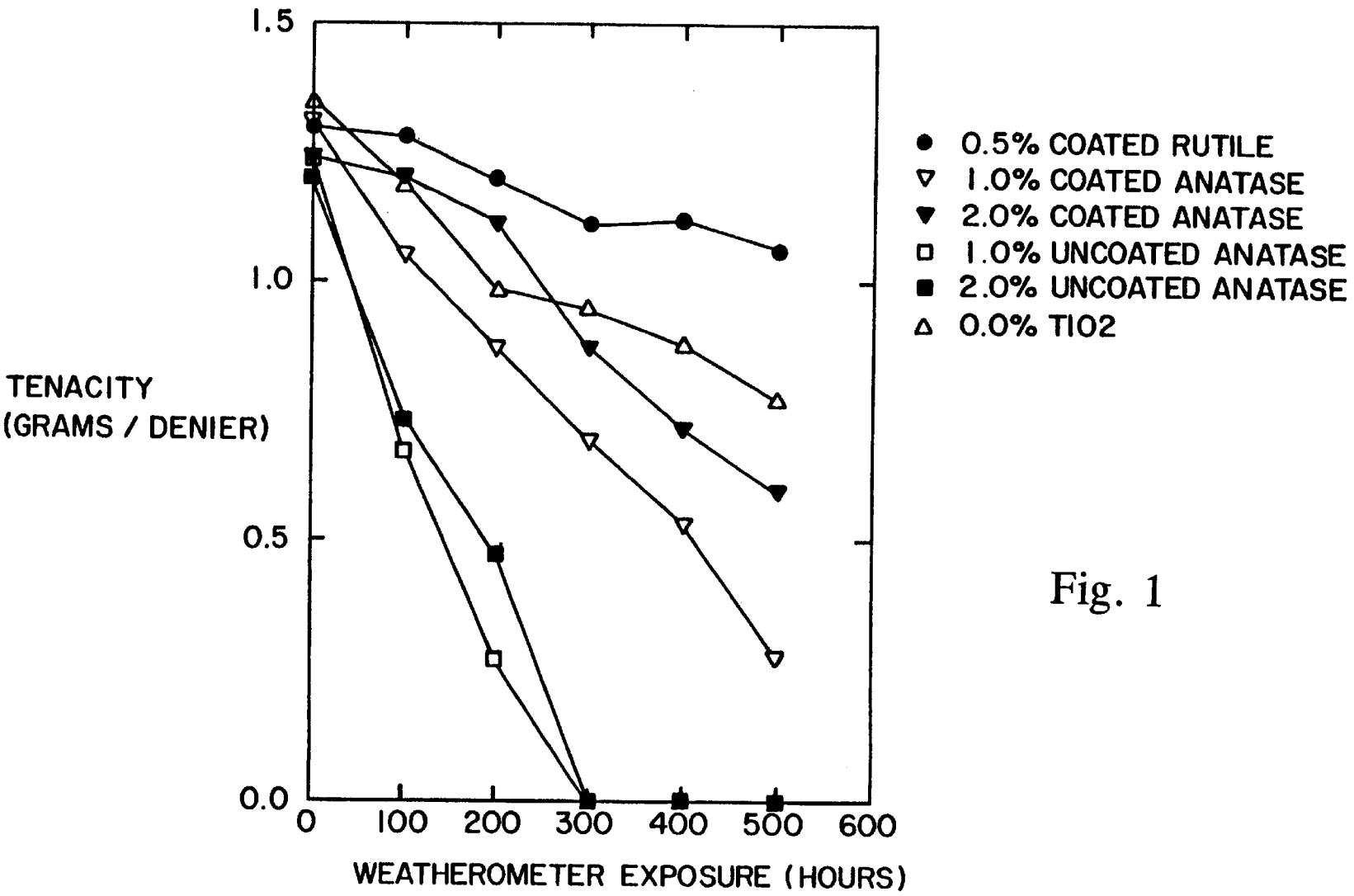
FIG. 1 is a plot of the tenacity loss of cellulose acetate fibers due to weathering. The tenacity in grams/denier is plotted versus weatherometer exposure in hours. The bold circle points represent 0.5% Rutile $TiO_2$, the bold inverted triangle points represent 2.0% coated Anatase $TiO_2$, the unshaded inverted triangle points represent 1.0% coated Anatase $TiO_2$, the unshaded square points represent 1.0% uncoated Anatase $TiO_2$, the bold square points represent 2.0% uncoated Anatase $TiO_2$, and the unshaded upright triangle points represent 0.0% $TiO_2$.

The present invention provides cellulose esters having a degree of substitution of 1.5 to 2.7 which are capable of efficient degradation by the action of microorganisms; also, by virtue of the inclusion of photooxidation catalysts which lower the particle size, the surface area of fiber prepared from the cellulose ester is increased, thereby providing a cellulose ester fiber composition which is capable of significant biodegradation when exposed to appropriate environmental conditions.

The present invention provides cellulose esters comprising repeating units of the formula:

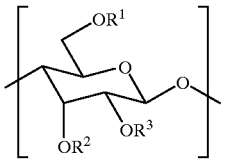

wherein $R^1$, $R^2$, and $R^3$ are independently selected from hydrogen or a straight chain alkanoyl group containing from 2 to about 10 carbon atoms.

The cellulose ester of the present invention will be a secondary cellulose ester. Examples of such esters include cellulose acetate, cellulose acetate propionate, and cellulose acetate butyrate. These cellulose esters are described in U.S. Pat. Nos. 1,698,049; 1,683,347; 1,880,808; 1,880,560; 1,984,147; 2,129,052; and 3,617,201, incorporated herein by reference.

The cellulose esters useful in the present invention can be prepared using techniques know per se in the art.

The cellulose esters of the present invention preferably have at least 2 anhydroglucose rings and most preferably between about 2 and 5,000 anhydroglucose rings. Also, such polymers typically have an inherent viscosity (IV) of about 0.2 to about 3.0 deciliters/gram, most preferably from about 1 to about 1.6, as measured at a temperature of 25° C. for a 0.5 gram sample in 100 ml of a 60/40 by weight solution of phenol/tetrachloroethane. In addition, the DS/AGU (degree of substitution per anhydroglycose unit) of the cellulose esters useful herein ranges from about 1.5 to about 2.7. Preferred esters of cellulose include cellulose acetate (CA), cellulose propionate (CP), cellulose butyrate (CB), cellulose acetate propionate (CAP), cellulose acetate butyrate (CAB), cellulose propionate butyrate (CPB), and the like. Cellulose acetates having a DS/AGU of 1.7 to 2.6 are especially preferred. The most preferred ester of cellulose is CA having a DS/AGU of 1.8 to 2.2 and an IV of 1.3 to 1.5.

The cellulose esters of the present invention can be spun into a fiber either by melt-spinning or by spinning from the appropriate solvent (e.g., acetone, acetone/water, tetrahydrofuran, methylene chloride/methanol, chloroform, dioxane, N, N-dimethylformamide, dimethylsulfoxide, methyl acetate, ethyl acetate, or pyridine). When spinning from a solvent, the choice of solvent depends upon the type of ester substituent and upon the DS/AGU. The preferred solvent for spinning fiber is acetone containing from 0 to 30% water. For cellulose acetate having a DS/AGU of 2.4–2.6, the preferred spinning solvent is acetone containing less than 2% water. For cellulose acetate having a DS/AGU of 2.0–2.4, the preferred spinning solvent is 5–15% aqueous acetone. For cellulose acetate having a DS/AGU of 1.7 to 2.0, the preferred solvent is 15–30% aqueous acetone. When melt-spinning fiber, it is preferred that the cellulose ester or plasticized cellulose ester have a melt temperature of 120° C. to 250° C. A more preferred melt temperature is from about 1 80° C. to 220° C. Examples of suitable plasticizers for use in melt spinning of cellulose esters include, but are not limited to, diethyl phthalate, dipropyl phthalate, dibutyl phthalate, tiacetin, dioctyl adipate, polyethylene glycol-200, or polyethylene glycol-400. Preferred plasticizers include dibutyl phthalate, dioctyl adipate, or polyethylene glycol-400.

The cellulose ester fibers preferably contain pigments which can act as photooxidation catalysts to accelerate the rate of decomposition of the cellulose esters when they are exposed to outdoor environments; the effect of the pigments can be augmented by the presence of metal salts, oxidizable promoters, or combinations thereof which can contribute to the degradation of the fibers by accelerating the thermooxidation processes. In summary, cellulose ester fibers preferably contain the following:

(i) Photoactive pigment, neat;

(ii) Photoactive pigment coated on an inert support such as silica, alumina, or silica-alumina;

(iii) Photoactive pigment+a promoting metal salt;

(iv) Photoactive pigment+a promoting metal salt coated on an inert support; or (v) Photoactive pigment+a promoting metal salt dispersed in the cellulose ester fiber;

(vi) i–v in combination with an oxidizable promoter such as poly(ethylene glycol), poly(tetramethylene glycol), or other materials whose oxidation can produce oxy-radical intermediates.

The pigments are preferably comprised of Anatase titanium dioxide alone or modified with up to 50 wt % of a variety of additional metals, i.e., a "thermooxidation augmentation metal salt", preferably 3–25% providing such compositions do not include Mn, Ce, or Co (these metals are known to decrease the photoactivity of titanium dioxide pigments: Newland G. C.; Irick, G. Jr.; Larkins, T. H. Jr., U.S. Pat. No. 4,022,632 (1977), incorporated herein by reference). The pigment can either be "chemically mixed" wherein the titanium dioxide is modified with the specified elements noted below (as denoted by the term "modifying elements") by sintering, i.e., heating a titanium oxide or other metal oxide physical mixture, by precipitating hydrous titania from a monomeric precursur such as titanium tetrachloride or titanium tetraisopropoxide in the presence of a solution containing the modifying element, or by ion exchange of the modifying element onto the amorphous or crystalline titania. In this fashion, the titanium dioxide catalyst so modified will be comprised of a certain amount of Ti—OM, Ti—OTi, and M—O—M bonds, wherein M is the modifying element as taught herein. As used herein, the term "chemically mixing" is used in the same sense that it is used in U.S. Pat. No. 5,011,806, incorporated herein by reference. Such metal salts can also be dispersed in the cellulose ester fiber, so long as some is in contact with the photoactive pigment; alternatively the metal salt can be coated onto the photoactive pigment. The pigment can also be comprised of a titanium dioxide layer coated on the surface of silica, alumina, or silica-alumina. In the cases where the titanium dioxide is coated on the surface of another metal oxide, the titanium dioxide layer will typically be less than 25% of the weight of the supporting oxide.

Examples of metals useful to augment thermooxidation processes include Cu, Fe, or Ni, introduced in the form of a salt such as nitrate, acetate, propionate, benzoate, chloride, and the like, or Ca, Mg, Ba, or Zn, preferably present as their sulfate or phosphate salts, or of sodium or potassium present as their sulfate salts. The metals are useful at concentrations of from 0.1 to 5% (w/w) based on the weight of the fiber, preferably at 0.2 to 1.0% (w/w).

Especially preferred embodiments of the present invention are cellulose ester fibers containing:

(i) 0.5–3% Anatase titanium dioxide pigment (wt/wt fiber) having 5% (wt/wt of pigment) of an iron salt coated thereon;

(ii) 0.5–3% Mixed oxide of titanium and aluminum (90/10 mol %);

(iii) 0.5–3% Mixed oxide of titanium and silicon (e.g., 90/10 mol %);

(iv) 0.5–3% Mixed oxide of titanium and iron (e.g., 90/10 mol %);

(v) 0.5–3% Anatase titanium dioxide pigment (wt/wt fiber) having 5 to 20% (wt/wt of fiber) of polyethylene glycol added;

(vi) 0.5–3% Anatase titanium dioxide pigment having from about 2–30 weight percent of a salt selected from the group consisting of sodium, potassium, zinc, magnesium, calcium, or barium sulfates coated thereon;

(vii) 0.5–3% Anatase titanium dioxide pigment having from about 2–30 weight percent of a salt selected from the group consisting of zinc, magnesium, calcium, or barium phosphates coated thereon;

(viii) The coated or modified pigment of (vii) above, wherein the salt concentration is 5–15 weight percent;

(ix) The coated or modified pigment of (viii) above, wherein the salt concentration is 5–15 weight percent;

(x) The coated or modified pigment of (viii) above, wherein the salt is calcium sulfate; and (xi) The coated or modified pigment of (ix) above, wherein the salt is calcium phosphate.

Any of the cellulose ester fibers of the present invention can optionally further comprise 0.001 to 50 weight percent, based on the total weight of the composition, of at least one additional additive selected from a thermal stabilizer, an antioxidant, a pro-oxidant, an acid scavenger, inorganics, and colorants.

As one embodiment of the present invention there is provided a cellulose ester fiber which comprises (a) a $C_1$–$C_{10}$ ester of cellulose having a degree of substitution per anhydroglycose unit (DS/AGU) of about 1.5 to about 2.7 and an inherent viscosity of about 0.2 to about 3.0 dL/g, as measured in a solution of 60/40 (wt/wt) phenol/tetrachloroethane, and (b) about 0.1–5 weight percent, based on the total weight of (a) and (b), of one or more photoactive metal oxides.

As a preferred embodiment of this aspect of the present invention, there is provided a cellulose ester fiber which comprises (a) a $C_1$–$C_{10}$ ester of cellulose having a degree of substitution per anhydroglycose unit (DS/AGU) of about 1.5 to about 2.7 and an inherent viscosity of about 0.2 to about 3.0 dL/g as measured in a solution of 60/40 (wt/wt) phenol/tetrachloroethane, and (b) about 0.1–5 weight percent, based on the total weight of (a) and (b), of Anatase titanium dioxide.

As a further preferred aspect of the present invention, there is provided a cellulose ester fiber which comprises (a) a $C_1$–$C_{10}$ ester of cellulose having a degree of substitution per anhydroglycose unit (DS/AGU) of about 1.5 to about 2.7 and an inherent viscosity of about 0.2 to about 3.0 dL/g, as measured in a solution of 60/40 (wt/wt) phenol/tetracloroethane;

(b) about 0.1–5 weight percent, based on the total weight of (a), of one or more photoactive metal oxides; and (c) one or more thermooxidation augmentation metal salts.

As a most highly preferred aspect of this embodiment of the present invention, there is provided a cellulose ester fiber which comprises (a) a $C_1$–$_4$ ester of cellulose having a degree of substitution per anhydroglycose unit (DS/AGU) of about 1.5 to about 2.5 and an inherent viscosity of about 0.2 to about 3.0 dL/g, as measured in a solution of 60/40 (wt/wt) phenol/tetracloroethane;

(b) about 0.1–5 weight percent, based on the total weight of (a), of Anatase titanium dioxide; and (c) one or more thermooxidation augmentation metal salts.

Experimental Section

Abbreviations used herein are as follows: "IV" is inherent viscosity; "g" is gram; "psi" is pounds per square inch; "cc" is cubic centimeter; "m" is meter; "rpm" is revolutions per minute; "DSAc" is degree of substitution per anhydroglucose unit for acetyl; "BOD" is biochemical oxygen demand; "vol" or "v" is volume; "wt" is weight; "mm" is millimeter; "NaOAc" is sodium acetate; "nm" is nanometer; "CE" is cellulose ester; "mil" is 0.001 inch. Relative to naming of the cellulose ester, "CA" is cellulose acetate.

Tenacity and elongation at break measurements of the fibers were made according to ASTM Standard Method 2101 and the tensile strength, elongation at break, and tangent modulus of the films are measured by ASTM method D882. Inherent viscosities are measured at a temperature of 25° C. for a 0.15 gram sample in 100 ml of a 60/40 by weight solution of phenol/tetrachloroethane. Molecular weight was measured by gel permentation chromatography using THF as the eluding solvent. The molecular weight is reported in polystyrene equivalents. Acetyl spread was measured by reverse-phase high pressure liquid chromatography using Acetone/MeOH water as the eluding solvent; the detector was a vaporative light scatter detector, the column was packed with polystyrene-divinylbenzene beads of 10 micron size, the column was 4.6×150 mm, and flow rate was 0.8 ml/min.

EXAMPLE 1

Cellulose acetate with different DS/AGU were prepared via hydrolysis of cellulose acetate with a DS/AGU of 2.5.

Typically, 29 lbs of cellulose acetate (DS=2.5) is dissolved in a mixture of 124 lbs of acetic acid and 53 lbs of water. The solution was heated to 60° C. before adding 551 g of sulfuric acid dissolved in 2 L of acetic acid. The reaction is held at this temperature for 2.5 to 8 h then 1320 g of $Mg(Oac)_2$ in 2.5 gal of water is added to the reaction mixture. The product is isolated by adding the reaction mixture to 40 gals of water. To this mixture is added 10 gals of water and stirring is continued an additional 30 min to ensure that the product was harden. The cellulose acetate is then isolated by filtration, washed, and stabilized with $NaHCO_3$ before drying at 80° C. Relative data is given in Table I.

TABLE 1

Hydrolysis time, DS/AGU, and IV for CA produced by acid hydrolysis.

| Entry | Hydrolysis Time (h) | DS/AGU | IV |
|---|---|---|---|
| 1 | 2.5 | 2.20 | 1.48 |
| 2 | 5 | 2.08 | 1.43 |
| 3 | 8 | 1.84 | 1.49 |

EXAMPLE 2

CA fibers, with an average degree of substitution of 2.5, were prepared with either 0.5% (wt/wt) coated Rutile $TiO_2$, 1.0% (wt/wt) coated Anatase $TiO_2$, 2.0% (w/w) coated Anatase $TiO_2$, 1.0% (wt/wt) uncoated Anatase $TiO_2$, 2.0% (w/w) uncoated Anatase $TiO_2$, or 0% (wt/wt) $TiO_2$. These fibers were then placed in an Atlas weatherometer and exposed to a sunshine carbon arc lamp. Samples of each fiber were taken at 100 hour intervals (up to 800 hours), and removed for evaluation of physical properties such as tenacity, elongation at break, molecular weight, and acetyl spread to determine the degree of photodegradation that had taken place.

Complete loss of fiber tenacity was observed for fiber samples containing either the 1% or the 2% (wt/wt) concentration of uncoated Anatase $TiO_2$ after only 300 hours of exposure in the weatherometer. Fibers containing either 1.0% or 2.0% (w/w) concentration of coated Anatase $TiO_2$ showed approximately a 47% and 30% loss in tensile strength, respectively. This clearly demonstrated that the addition of a coating to the Anatase $TiO_2$ decreased its photoreactivity. In contrast, those fiber samples containing 0.5% coated Rutile $TiO_2$ showed only a 14% decrease in tensile strength after the same 300 hours exposure time. These results are summarized in FIG. 1 and Table II.

TABLE II

Tenacity (g/denier) of CA fibers after varying periods of exposure in the weatherometer.

| Sample | 0 hrs | 100 hrs | 200 hrs | 300 hrs | 400 hrs | 500 hrs |
|---|---|---|---|---|---|---|
| 0.5% Rutile (coated) | 1.30 | 1.28 | 1.20 | 1.11 | 1.12 | 1.06 |
| 1.0% Anatase (coated) | 1.31 | 1.05 | 0.87 | 0.69 | 0.53 | 0.27 |
| 2.0% Anatase (coated) | 1.24 | 1.20 | 1.11 | 0.87 | 0.71 | 0.59 |
| 1.0% Anatase (uncoated) | 1.24 | 0.67 | 0.27 | 0.0 | 0.0 | 0.0 |
| 2.0% Anatase (uncoated) | 1.20 | 0.73 | 0.47 | 0.0 | 0.0 | 0.0 |
| 0.0% $TiO_2$ | 1.35 | 1.19 | 0.99 | 0.95 | 0.88 | 0.77 |

Figure 2:
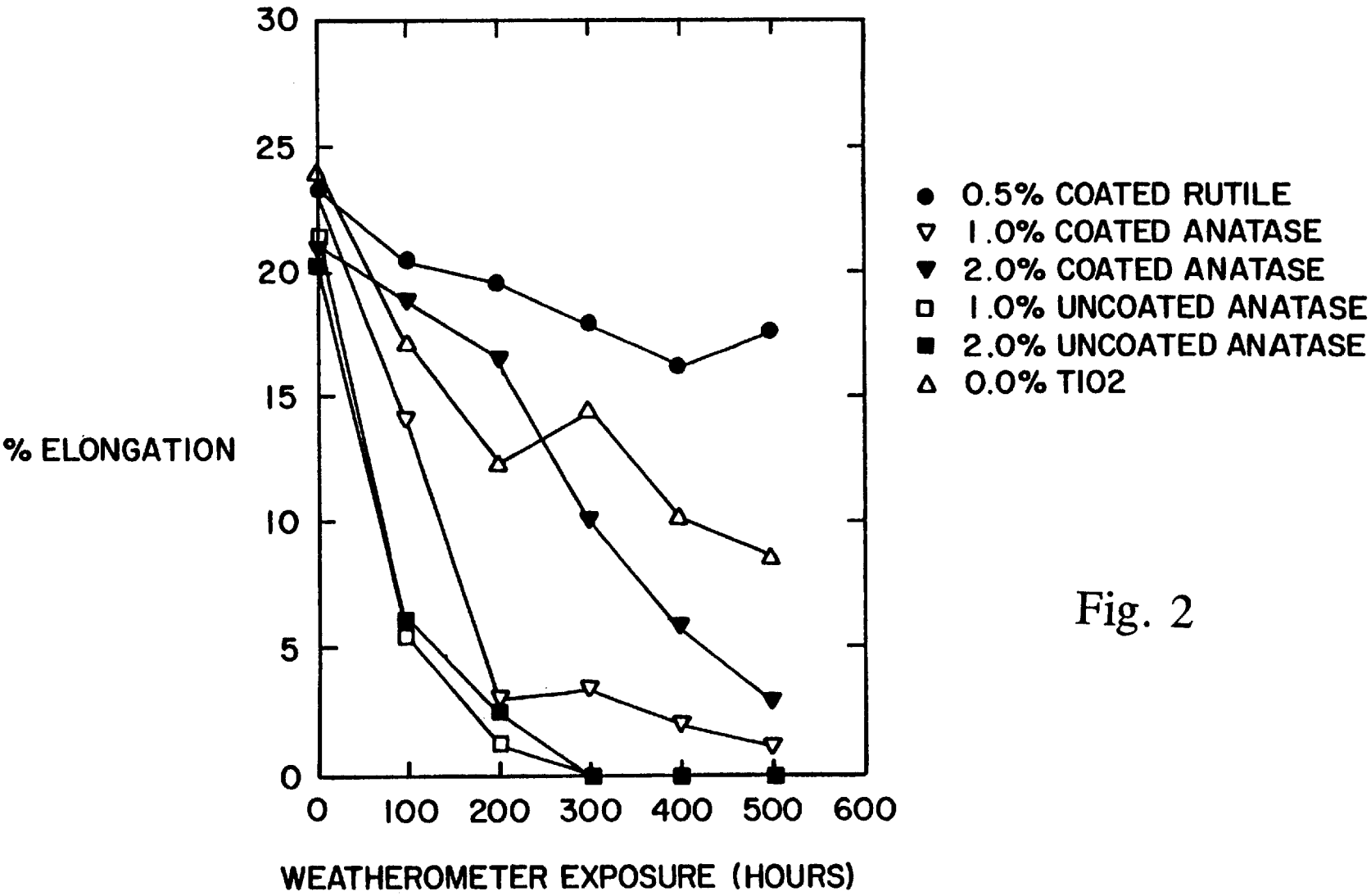
FIG. 2 represents the percent elongation loss of cellulose acetate fibers due to weathering. The percent elongation is plotted versus weatherometer exposure in hours. The points represent the same pigment as denoted in FIG. 1, above.

Changes in the elongation at break for uncoated Anatase $TiO_2$ treated fibers were consistent with results obtained from tenacity measurements. Those samples containing either the 1% or the 2% (w/w) concentration of uncoated Anatase $TiO_2$ completely failed after only 300 hours of exposure in the weatherometer. The coating of Anatase $TiO_2$ imparted more resistance to ultraviolet irradiation than those without a coating, but still yielded an 85% and 52% loss in elongation for the 1% and 2% Anatase-treated samples respectively. Both the uncoated and coated Anatase were significantly better with respect to sensitivity to photodegradation, than the coated Rutile sample which lost an average of only 23% of its original percent elongation. These results are shown in tabular form in Table III and in graphic form in FIG. 2.

TABLE III

Elongation at break (%) of CA fibers after varying periods of exposure in the weatherometer.

| Sample | 0 hrs | 100 hrs | 200 hrs | 300 hrs | 400 hrs | 500 hrs |
|---|---|---|---|---|---|---|
| 0.5% Rutile (coated) | 23.3 | 20.3 | 19.5 | 18.0 | 16.2 | 17.6 |
| 1.0% Anatase (coated) | 23.0 | 14.0 | 8.0 | 3.4 | 2.1 | 1.1 |
| 2.0% Anatase (coated) | 20.9 | 18.8 | 16.4 | 10.0 | 5.8 | 2.9 |
| 1.0% Anatase (uncoated) | 21.2 | 5.4 | 1.3 | 0.0 | 0.0 | 0.0 |
| 2.0% Anatase (uncoated) | 20.2 | 6.2 | 2.5 | 0.0 | 0.0 | 0.0 |
| 0.0% $TiO_2$ | 24.2 | 17.2 | 12.3 | 14.5 | 10.2 | 8.6 |

Figure 3:
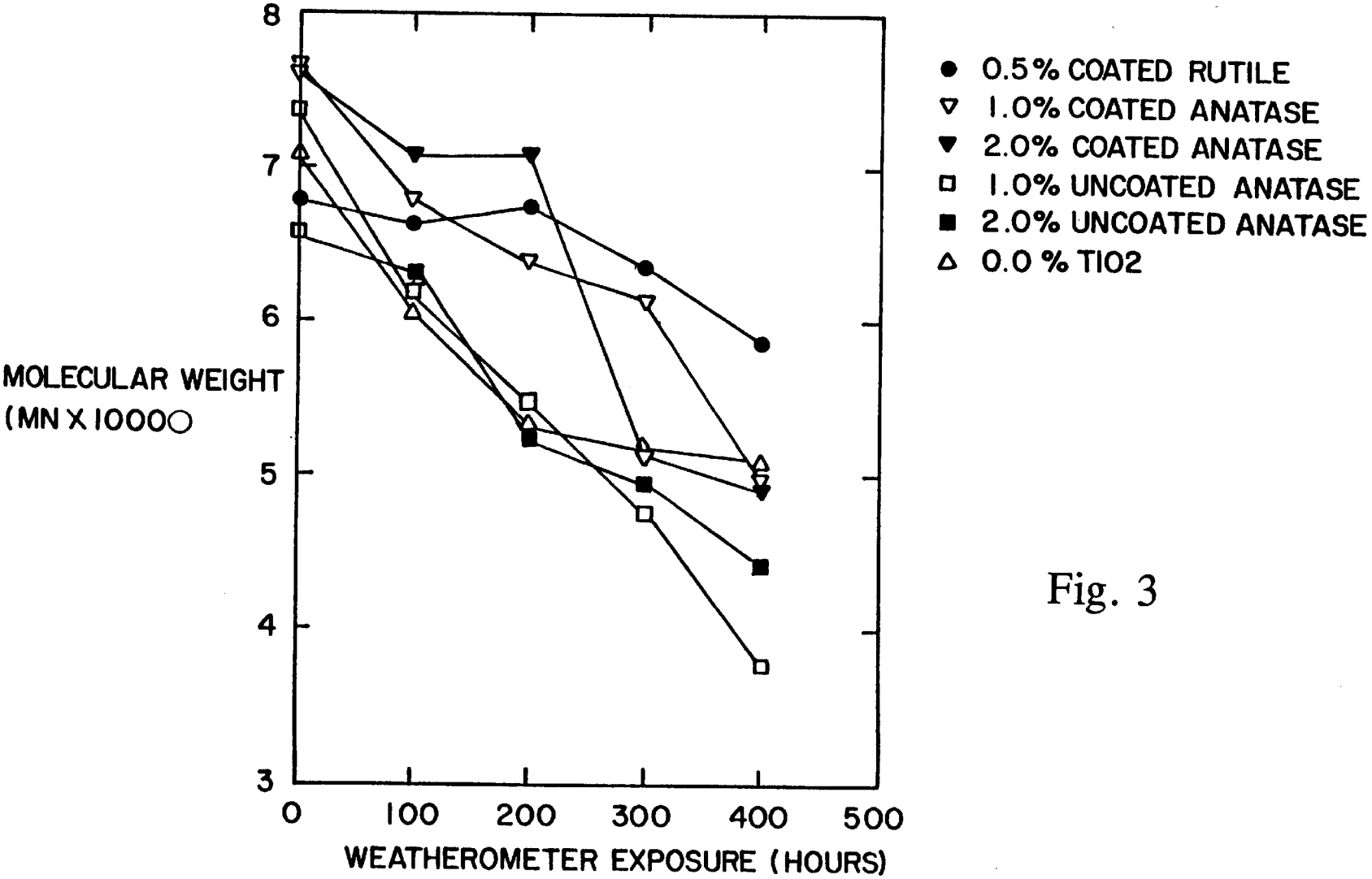
FIG. 3 depicts the change in number average molecular weight of cellulose acetate fibers due to weathering. Molecular weight (Mn×10,000) is plotted versus weatherometer exposure in hours. The points represent the same pigment as denoted in FIG. 1, above.

Fiber samples were analyzed using gel permeation chromatography techniques to determine molecular weight changes. Significant decreases were observed in the number average molecular weights for all samples after 400 hours exposure, however, the samples having 1.0% and 2.0% (wt/wt) uncoated Anatase $TiO_2$ exhibited the largest decrease in number average molecular weight. The 1.0% uncoated Anatase $TiO_2$ showed the largest decrease in number average molecular weight (49%), while the 2.0% uncoated Anatase $TiO_2$ lost an average of 33% of its original number average molecular weight. These results are shown in FIG. 3.

Fiber samples were also analyzed using a high performance liquid chromatographic assay for acetyl content and acetyl spread. Only the fiber samples which had the uncoated Anatase $TiO_2$ displayed significant differences in both acetyl average and acetyl spread after 400 hours of exposure to the ultraviolet lamp. The lower acetyl average values showed a loss of acetyl groups from the CA polymer which is indicative of degradation. These values are depicted in Table IV.

TABLE IV

Acetyl average (%) and acetyl spread of CA fibers after varying periods of exposure in the weatherometer.

| | 0 Hrs | | 300 Hrs | | 400 Hrs | |
|---|---|---|---|---|---|---|
| Sample | Average | Spread | Average | Spread | Average | Spread |
| 0.5% Rutile (coated) | 39.2 | 4.4 | 39.3 | 4.4 | 39.2 | 4.4 |
| 1.0% Anatase (coated) | 39.2 | 4.4 | 39.2 | 4.4 | 39.0 | 4.7 |
| 2.0% Anatase (coated) | 39.2 | 4.4 | 39.3 | 4.4 | 39.0 | 4.7 |
| 1.0% Anatase | 39.2 | 4.4 | 39.1 | 4.6 | 38.6 | 5.3 |

TABLE IV-continued

Acetyl average (%) and acetyl spread of CA fibers after varying periods of exposure in the weatherometer.

| Sample | 0 Hrs | | 300 Hrs | | 400 Hrs | |
|---|---|---|---|---|---|---|
| | Average | Spread | Average | Spread | Average | Spread |
| (uncoated) 2.0% Anatase | 39.2 | 4.4 | 39.2 | 4.4 | 38.7 | 5.0 |
| (uncoated) 0.0% $TiO_2$ | 39.2 | 4.4 | 39.3 | 4.4 | 39.0 | 4.7 |

EXAMPLE 3

Figure 4:
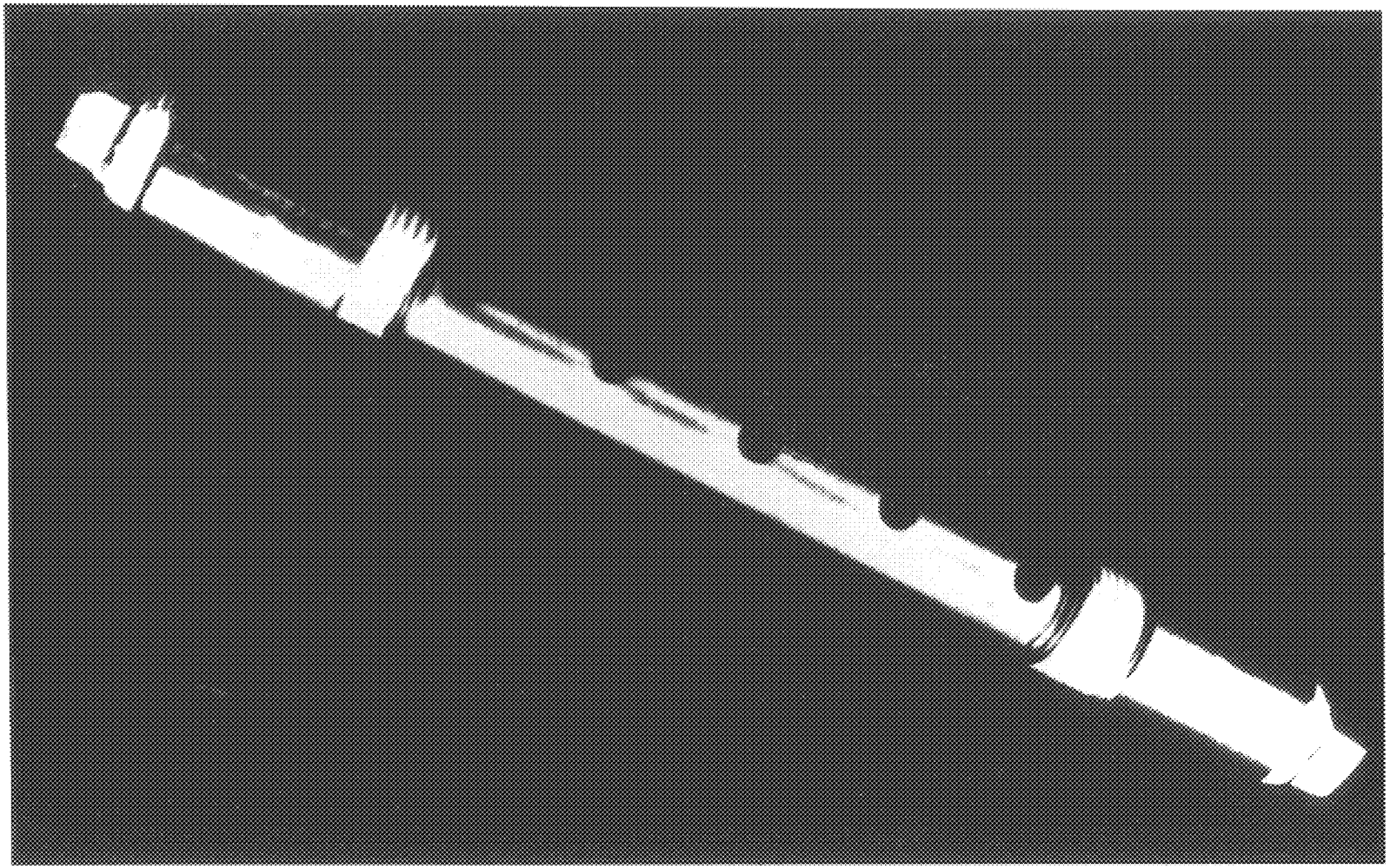
FIG. 4 is a picture of the type of cylinder used for suspending film strips in wastewater basins. Strips of film 0.5 inches wide and 6 inches long of known weight and thickness were placed in the cylinder which was attached to a steel cable and immersed in a wastewater basin.
Figure 5:
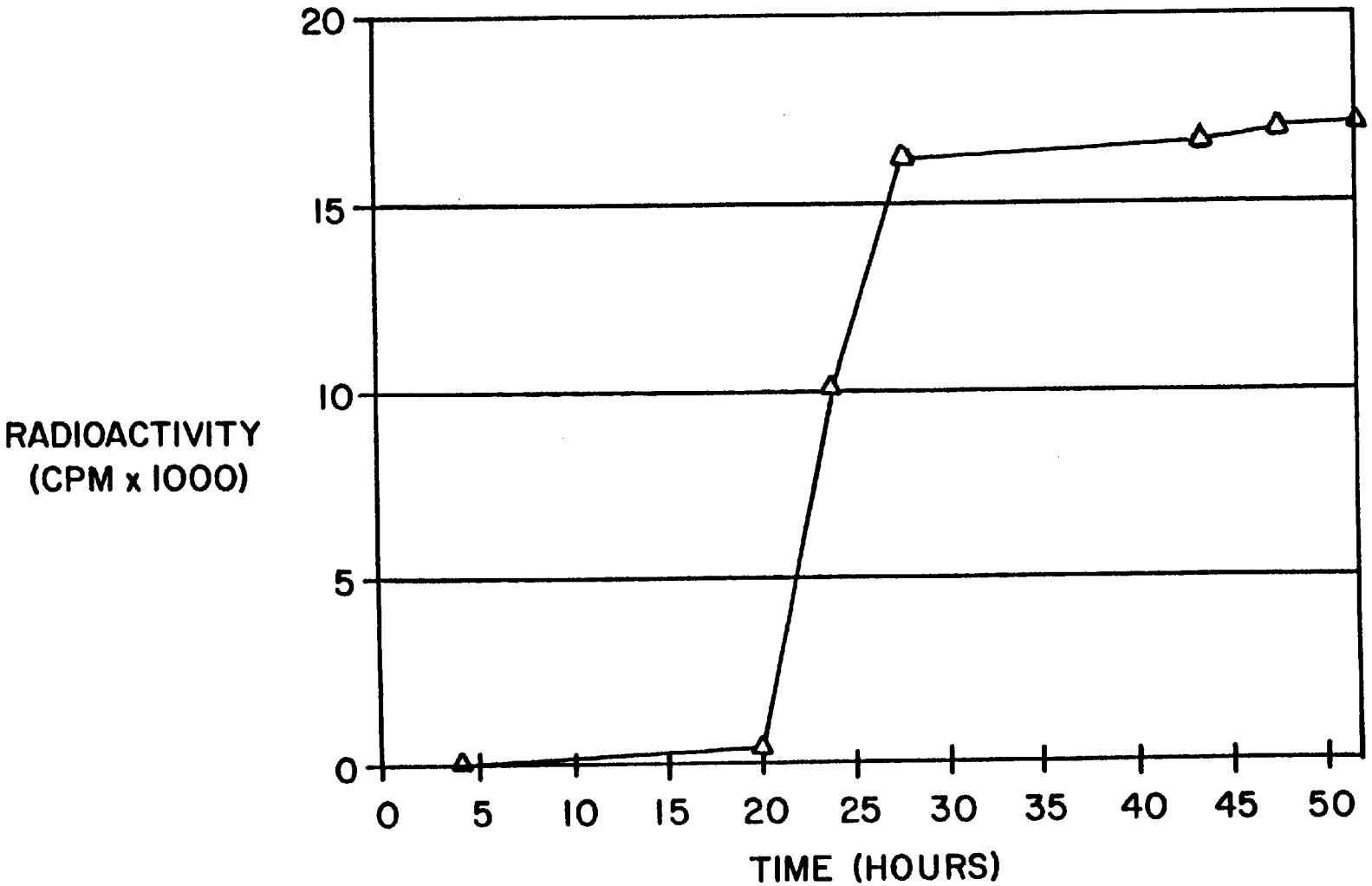
FIG. 5 depicts the microbial production of $^{14}C—CO_2$ from cellulose [1—$^{14}C$] acetate having a DS/AGU of 1.6. In this example, the CA is in the form of a flake with relatively high surface area.
Figure 6:
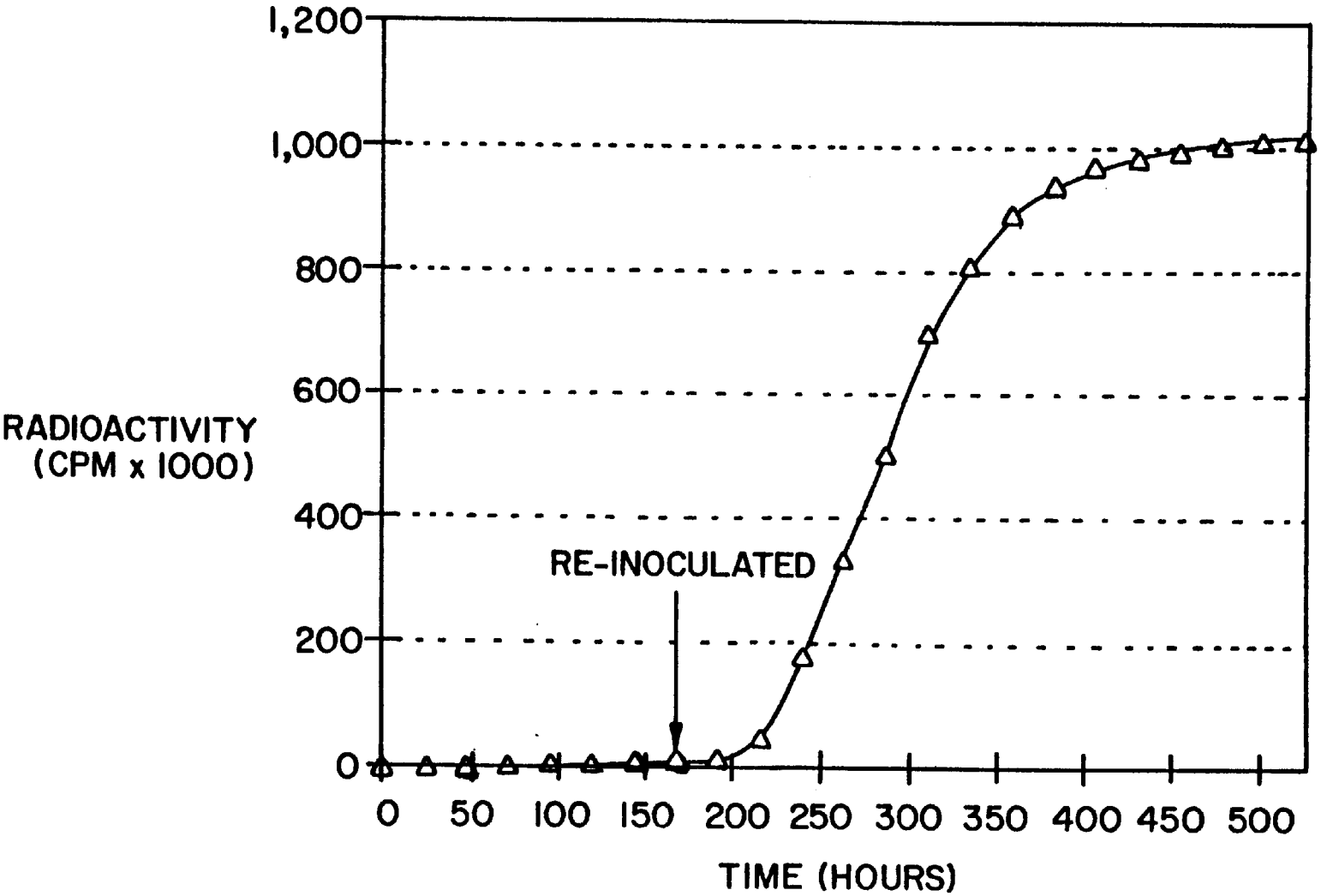
FIG. 6 depicts the microbial production of $^{14}C—CO_2$ from cellulose [1—$^{14}C$] acetate having a DS/AGU of 1.85. In this example, the CA is in the form of a film that offers relatively low surface area.
Figure 7:
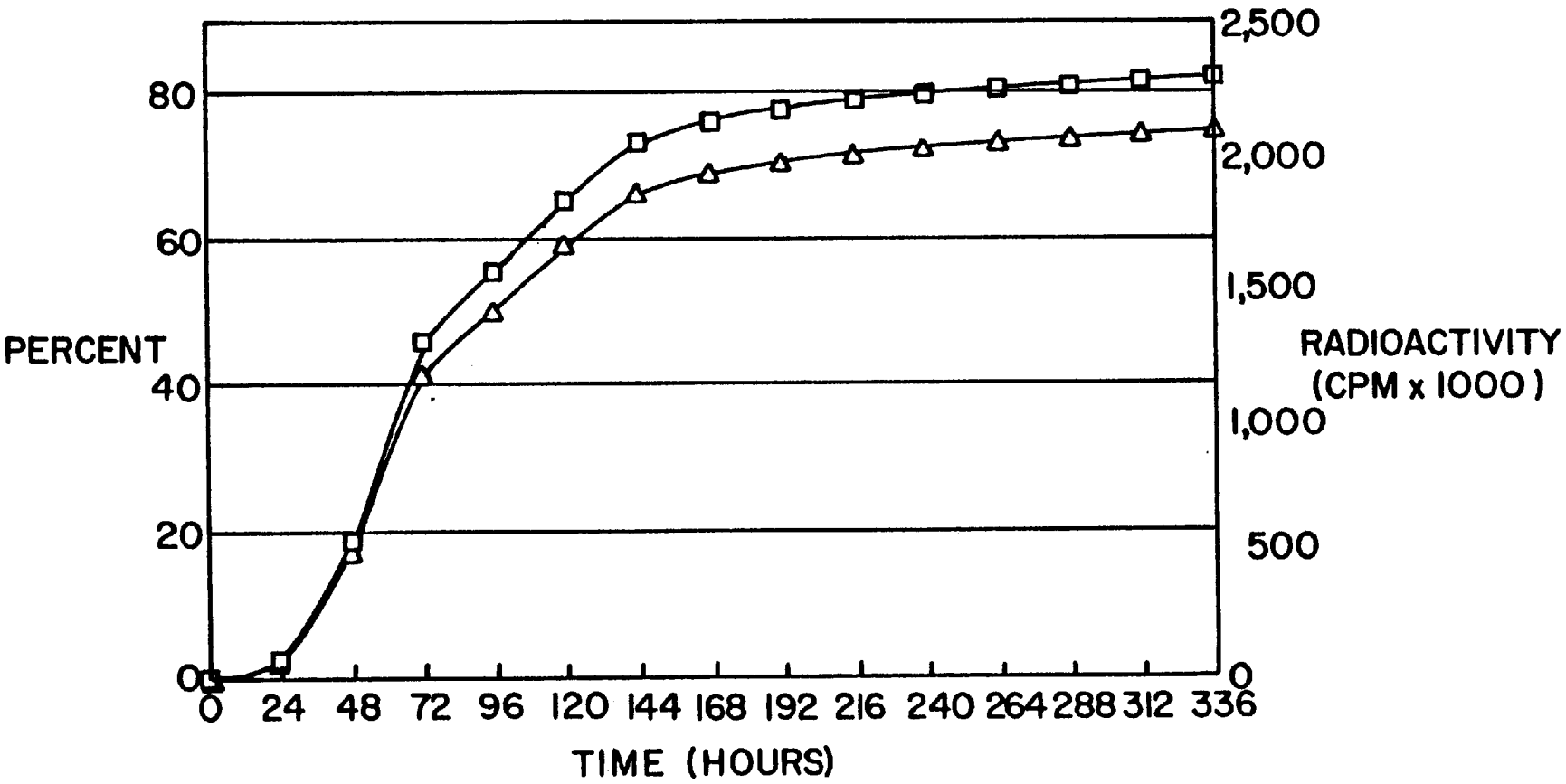
FIG. 7 depicts the production of $^{14}CO_2$ from labeled cellulose acetate (degree of substitution is 1.85). This plot documents that significant mineralization of the original polymeric carbon to $CO_2$ and $H_2O$ has occurred. The "square points" represent percent acetyl conversion and the "triangle points" represent $^{14}CO_2$ collected in counts per minute.

We have found that when films of cellulose acetate having a degree of substitution of 1.7 were immersed in the Tennessee Eastman Division (of Eastman Chemical Company (Kingsport, Tenn., U.S.A.)) wastewater treatment facility, extensive degradation of the films occurred within 27 days. In addition, a culture consisting of a mixed population of microbes isolated from the activated sludge obtained from the same wastewater treatment facility were grown in the presence of films of the same cellulose acetate (DS=1.7). In this case, extensive degradation of the cellulose acetate films was observed after 5 days. FIGS. 4A and 4B show scanning electron microscopy (SEM) photographs of the two sides of cellulose acetate films formed by drawing a film from a solution consisting of 20% cellulose acetate (DS=1.7) by weight in a 50/50 mixture of water/acetone. FIGS. 4A and 5A are of a control film while FIGS. 4B and 5B are of a film on which the culture, consisting of a mixed population of microbes isolated from the activated sludge, were grown for 4 days. In FIGS. 4B and 5B extensive degradation of the cellulose acetate film is evident. Comparison of the control films in FIGS. 4A and 5A shows that the film sides are different. FIG. 4A shows the outer, smooth surface of the film which results from shearing by the draw blade while FIG. 5A shows the inner, rough surface of the film which was in contact with the surface on which the film was cast. Comparison of FIGS. 4B and 5B shows that the rough or inner side of the film was more extensively degraded. A rough or high surface area promotes attachment of the bacteria leading to a more rapid rate of degradation. Processes, such as photodegradation and the like, which promote increased surface areas are desirable in the practice of this invention. FIGS. 6 and 7 show SEM photographs of the smooth and rough sides of a cellulose acetate film from which the bacteria were not washed. In addition to showing extensive pitting of the film surface due to degradation of the cellulose acetate, these films show the attached microbes in the cavities where degradation is occurring.

In vitro Enrichment System: fresh composite samples of activated sludge are obtained from the AA 03 aeration basins in the Tennessee Eastman (Kingsport, Tenn., U.S.A.) wastewater treatment plant which has a design capacity of receiving 25 million gallons of waste per day with BOD concentration up to 200,000 pounds per day. The major waste components consist largely of methanol, ethanol, isopropanol, acetone, acetic acid, butyric acid, and propionic acid. The sludge operating temperatures vary between 35° C. to 40° C. In addition, a dissolved oxygen concentration of 2.0 to 3.0 ppm and a pH of 7.1 are maintained to ensure maximal degradation rates. The activated sludge serves as the starting inoculum for the stable mixed population of microbes used in this invention. A stable population is obtained by serially transferring the initial inoculum (5% v/v) to a basal salt media containing glucose or cellobiose, acetate, and cellulose acetate (DS=2.5).

Cellulose ester film degrading enrichments are initiated in a basal salts medium containing the following ingredients per liter: 50 ml of Pfennig's Macro-mineral solution, 1.0 ml of Pfennig's trace element solution, 0.1% (wt/vol) Difco yeast extract, 2 mM $Na_2SO_4$, 10 mM $NH_4Cl$ which supplements the ammonia levels provided by Pfennig's Macro-mineral solution, 0.05% (wt/vol) cellobiose, 0.05% (wt/vol) NaOAc. This solution is adjusted to pH 7.0 and a final volume of 945 ml before being autoclaved at 121° C. at 15 psi for minutes. After cooling to room temperature, 50 ml of sterile 1 M phosphate buffer and 5 ml of a complex vitamin solution which has been filtered through a 0.2 mm filter are added. The test cellulosic film is then added and the flask is inoculated (5% v/v) with a stable mixed population enrichment. The flask is placed in a New Brunswick incubator and held at 30° C. and 250 rpm for the appropriate period. Initially, the films are often observed to turn cloudy and to be coated with a yellow affinity substance (*Current Microbiology*, 9, 195 (1983)) which is an indication of microbial activity. After 4 to 12 days, the films are broken into small pieces at which time they are harvested by pouring the media through a filter funnel. The pieces are collected and washed with water. The film pieces are suspended in a neutral detergent solution at 90° C. for 30–60 minutes before washing extensively with water. The films are placed in a vacuum oven at 40° C. until dry (to a constant weight) before weighing. In each experiment, control experiments are conducted in which the films are subjected to the same experimental protocol except inoculation with the microbes.

Cellulose Acetate, DS=1.7.

| Film Number | Original Weight (mg) | Final Weight (mg) | % Weight Loss |
|---|---|---|---|
| 1* | 190 | 181 | 5 |
| 2* | 233 | 220 | 6 |
| 3* | 206 | 196 | 5 |
| 4 | 134 | 2 | 99 |
| 5 | 214 | 35 | 84 |
| 6 | 206 | 16 | 92 |
| 7* | 195 | 184 | 5 |
| 8* | 187 | 175 | 6 |
| 9 | 177 | 3 | 98 |
| 10 | 181 | 5 | 97 |
| 11* | 167 | 164 | 2 |
| 12* | 174 | 173 | 1 |
| 13* | 188 | 185 | 2 |
| 14 | 192 | 30 | 84 |
| 15 | 154 | 5 | 97 |

Films 1–6, 7–10, and 11–15 represent the results for three separate experiments. Films 1–6 and 11–15 are shaken for 4 days while Films 7–10 are shaken for 5 days. The films with the * represent control films. In every case, weight loss of 84–99% is observed for the inoculated films and only 0.6–6.4% for the control films.

Cellulose Acetate, DS=2.5.

| Film Number | Original Weight (mg) | Final Weight (mg) | % Weight Loss |
|---|---|---|---|
| 1* | 135 | 136 | 0 |
| 2* | 161 | 161 | 0 |
| 3* | 132 | 131 | 0.8 |
| 4* | 147 | 148 | 0 |
| 5 | 146 | 40 | 73 |
| 6 | 169 | 60 | 65 |

-continued

| Film Number | Original Weight (mg) | Final Weight (mg) | % Weight Loss |
|---|---|---|---|
| 7 | 175 | 81 | 54 |
| 8 | 157 | 36 | 77 |

Each film is shaken for 12 days. The films with the * represent control films. In every case, weight losses of 54–77% are observed for the inoculated films and 0–0.8% for the control films. As expected, the films with a higher degree of substitution exhibit greater resistance to microbial attack.

Figure 8:
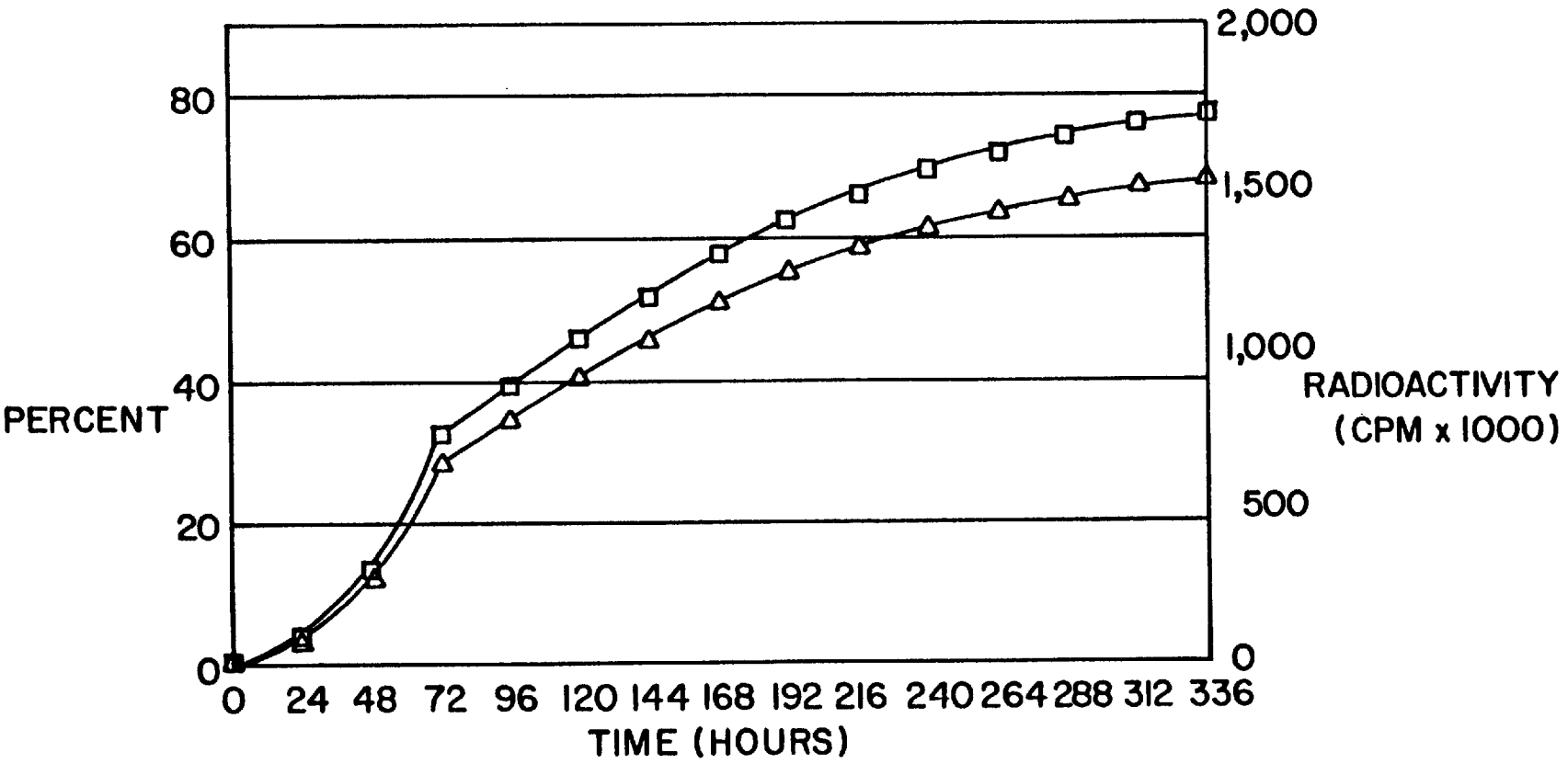
FIG. 8 depicts the production of $^{14}CO_2$ from labeled cellulose acetate (degree of substitution is 2.0). This plot documents that significant mineralization of the original polymeric carbon to $CO_2$ and $H_2O$ has occurred. The "triangle points" represent percent acetyl conversion and the "square points" represent $^{14}CO_2$ collected in counts per minute.

Wastewater Treatment Studies: Fifteen numbered cylinders, such as the one shown in FIG. 8, containing one cellulose acetate film each are attached to a steel cable and suspended in Tennessee Eastman's AD 02 basin. Films 14 are harvested after 21 days while Films 5–14 are harvested after 27 days. The harvested films are suspended in a neutral detergent solution at 90° C. for 30–60 minutes before washing extensively with water. The films are placed in a vacuum oven at 40° C. until dry before weighing.

Cellulose Acetate, DC=1.7.

| Film No | Original Wt (mg) | Final Wt (mg) | % Wt. Loss | Original Thickness | Final Thickness | % Thickness Loss |
|---|---|---|---|---|---|---|
| 1 | 223 | 176 | 21 | 6.40 | 5.28 | 18 |
| 2 | 217 | 172 | 21 | 6.33 | 5.59 | 12 |
| 3 | 187 | 150 | 20 | 5.61 | 5.30 | 6 |
| 4 | 249 | 200 | 20 | 5.96 | 5.48 | 8 |
| 5 | 186 | 51 | 73 | 5.56 | 4.08 | 21 |
| 6 | 243 | 75 | 69 | 6.95 | 4.78 | 31 |
| 7 | 220 | 62 | 72 | 6.35 | — | — |
| 8 | 243 | 78 | 68 | 6.29 | 4.55 | 28 |
| 9 | 201 | 19 | 91 | 5.40 | 4.30 | 19 |
| 10 | 146 | 28 | 81 | 5.97 | 4.08 | 32 |
| 11 | 201 | 21 | 90 | 5.79 | 3.83 | 34 |
| 12 | 160 | 44 | 73 | 5.66 | 4.65 | 18 |
| 13 | 197 | 70 | 65 | 6.59 | 4.93 | 25 |
| 14 | 199 | 50 | 75 | 5.71 | 4.92 | 14 |

The films tested after 21 days show a weight loss of 20–21% while the films tested after 27 days show a weight loss of 65–91%. The large loss in film weight and thickness between days 21 and 27 is typical. Generally, an induction period is observed during which microbial attachment is occurring. When the bacteria are attached and enough degradation has occurred to expose more surface area, the rate of degradation increases. Films 2–4 are intact enough so that testing of mechanical properties and comparison to control films (A–C) is possible:

| Film Number | Tangent Modulus ($10^5$ psi) | Tensile Strength ($10^3$ psi) |
|---|---|---|
| 2 | 1.47 | 2.62 |
| 3 | 1.25 | 1.49 |
| 4 | 1.44 | 2.62 |
| A | 2.63 | 4.85 |
| B | 2.91 | 6.04 |
| C | 2.41 | 5.09 |

In each case, substantial loss in the tangent modulus and tensile strength is observed which illustrates how the microbial degradation of the test films leads to loss in film properties.

Compost Biodegradation Assays: Composting can be defined as the microbial degradation and conversion of solid organic waste into soil. One of the key characteristics of compost piles is that they are self heating; heat is a natural by-product of the metabolic breakdown of organic matter. Depending upon the size of the pile, or its ability to insulate, the heat can be trapped and cause the internal temperature to rise.

Efficient degradation within compost piles relies upon a natural progression or succession of microbial populations to occur. Initially the microbial population of the compost is dominated by mesophilic species (optimal growth temperatures between 20–45° C.). The process begins with the proliferation of the indigenous mesophilic microflora and metabolism of the organic matter. This results in the production of large amounts of metabolic heat which raise the internal pile temperatures to approximately 55–65° C. The higher temperature acts as a selective pressure which favors the growth of thermophilic species on one hand (optimal growth range between 45–60° C.), while inhibiting the mesophiles on the other. Although the temperature profiles are often cyclic in nature, alternating between mesophilic and thermophilic populations, municipal compost facilities attempt to control their operational temperatures between 55–60° C. in order to obtain optimal degradation rates. Municipal compost units are also typically aerobic processes, which supply sufficient oxygen for the metabolic needs of the microorganisms permitting accelerated biodegradation rates.

In order to assess the biodegradation potential of the test films, small-scale compost units were employed to simulate the active treatment processes found in municipal solid waste compost. These bench-scale units displayed the same key features that distinguish the large-scale municipal compost plants. The starting organic waste was formulated to be representative of that found in municipal sold waste streams: a carbon to nitrogen of 25:1 ratio, a 55% moisture content, a neutral pH, a source of readily degradable organic carbon (eg. cellulose, protein, simple carbohydrates, and lipids), and had a particle size that allowed good air flow through the mass. Prior to being placed in a compost unit, all test films were carefully dried and weighed. Test films were mixed with the compost at the start of an experiment and incubated with the compost for 10 or 15 days. The efficiency of the bench scale compost units were determined by monitoring the temperature profiles and dry weight disappearance of the compost. These bench scale units typically reached 60–65° C. within 8 hours. After 15 days of incubation there was typically a 40% dry weight loss in the compost. Films were harvested after 10 or 15 days of incubation and carefully washed, dried, and weighed to determine weight loss. The following is representative of the results of such composting experiments for cellulose acetate films:

Composting Results: 15 day Composting Trial

| Degree of Substitution | Weight Loss | Film Thickness |
|---|---|---|
| 2.50 | About 1% | 0.88 mil |
| 2.21 | 38.4% | 1.39 mil |
| 2.06 | 100% | 1.47 mil |
| 1.86 | 100% | 4.49 mil |
| 1.74 | 100% | 0.65 mil |

EXAMPLE 4

Carbon 14 labeled cellulose acetate was prepared according to the general procedure described by Buchanan, et al.

(*Macromolecules* 1991, 24, 3050). The following is representative of a typical experiment: Cellulose (5.02 g) was treated with 9.4 ml (83 uCi) of [1—$^{14}$C]-acetyl chloride and 13.1 ml of trifluoroacetic anhydride in 55 ml of trifluoroacetic acid at 5° C. for 65 min. The reaction temperature was raised to 25° C. for 4 h and finally to 50° C. for 1 h. The product was isolated by precipitation into water followed by extensive washing and drying which provided 8.34 g of cellulose [1—$^{14}$C]-triacetate having a specific activity of 8.02 uCi/g.

Figure 9:
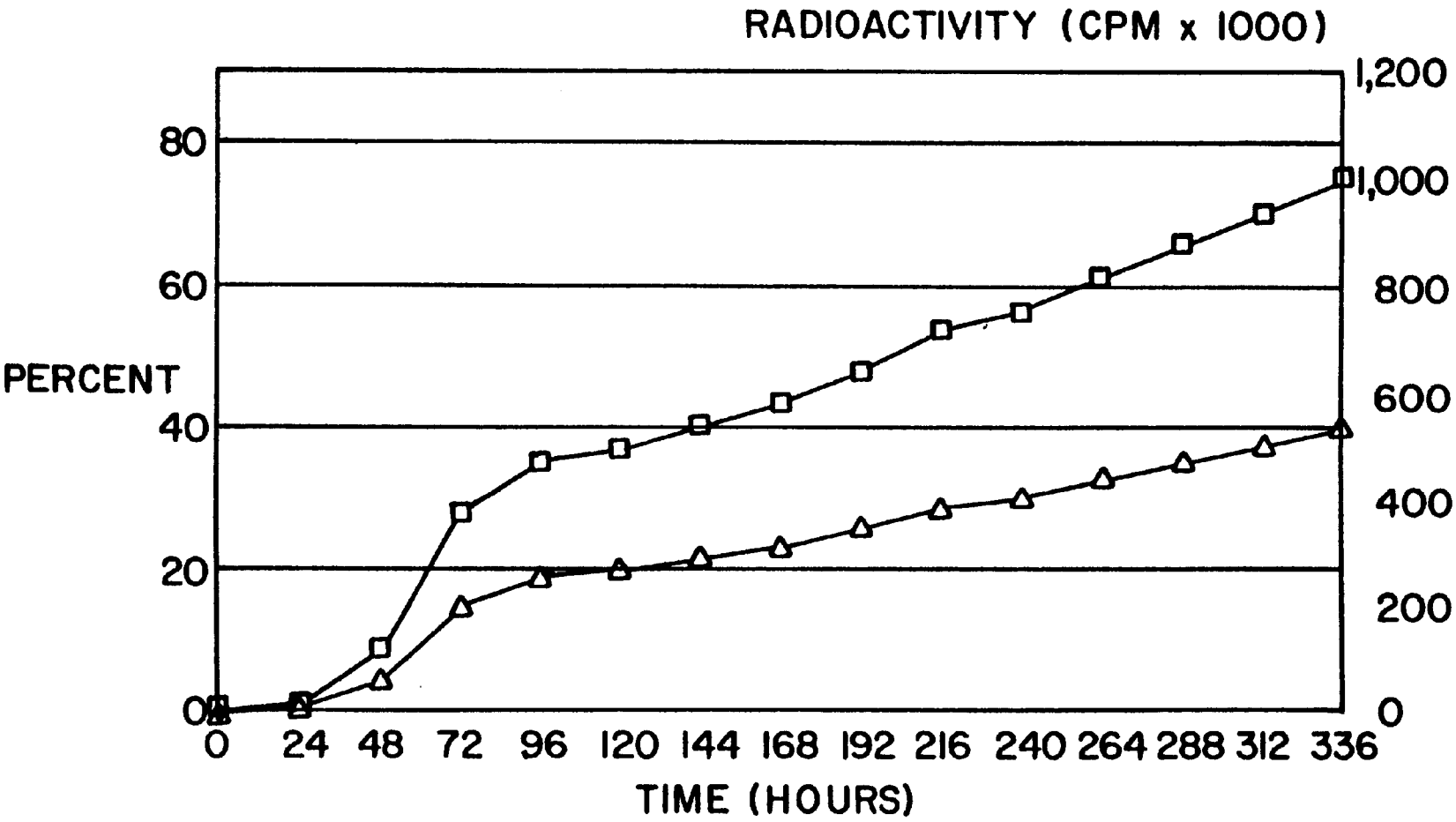
FIG. 9 depicts the production of $^{14}CO_2$ from labeled cellulose acetate (degree of substitution is 2.5). This plot documents that significant mineralization of the original polymeric carbon to $CO_2$ and $H_2O$ has occurred. The "triangle points" represent percent acetyl conversion and the "square points" represent $^{14}CO_2$ collected in counts per minute.
Figure 10:
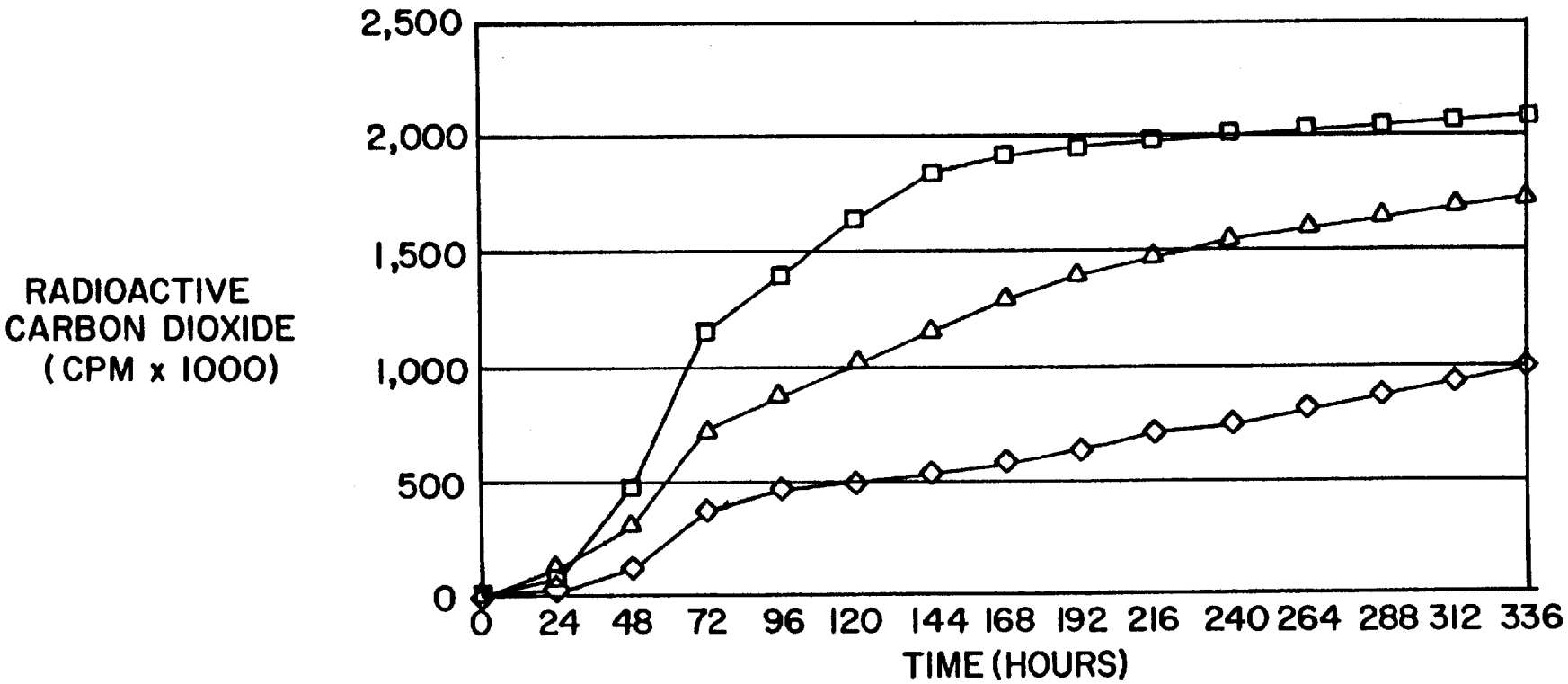
FIG. 10 depicts the microbial production of $^{14}CO_2$ from labeled cellulose acetate at three different degrees of substitution. The "square points" represent a degree of substitution of 1.85, "triangle points" represent 2.0, and "diamond points" represent 2.5. This plot illustrates the effect of degree of substitution on biodegradation rates.

Cellulose [1—$^{14}$C]-triacetate (2.12 g) was dissolved in 42 ml of acetic acid and heated to 50° C. before a solution of 6.26 ml of water containing 50 mg of $H_2SO_4$ was added to the reaction mixture. This material was back-hydrolyzed to provide [1—$^{14}$C] labeled cellulose acetate with the following degrees of substitution: 1.85, 2.0, and 2.5. The specific activities of the starting materials were 4.46 uCi/g, 5.73 uCi/g, and 2.5 uCi/g, respectively. FIG. 9 depicts preliminary experiments with a 1.6 DS CA that was used to test the $^{14}CO_2$ collection system. Approximately 1 uCi of the respective esters were individually incubated in the in vitro enrichment assay at 30° C. for 340 hrs. FIGS. 10 and 11 illustrate the microbial production of $^{14}CO_2$ from labeled $^{14}$C-cellulose acetate with a DS of 1.85. After 330 hrs approximately 82% of the original starting label was converted into $^{14}CO_2$ (FIG. 11). FIG. 12 illustrates the same trend as shown in FIGS. 10 and 11, but at a slightly lower efficiency due to the higher DS. After 330 hrs, only about 78% of the original starting label was accounted for as $^{14}CO_2$. FIG. 13 shows the effect of increasing DS on biodegradation rates more clearly. After 330 hrs just under 40% of the starting label was collected as $^{14}CO_2$. FIG. 14 represents a composite of all three cellulose esters. Note the shorter lag time necessary for the 1.85 DS material compared to the higher substituted 2.0 and 2.5 materials.

EXAMPLE 5

To a solution of approximately 2% (wt/wt) of CA (DS/AGU=2.5) in acetone was added 2.0 g of pigment. The slurry was stirred during irradiation at 350 nm for varying amounts of time. Acid numbers were used to monitor the oxidation process.

| Entry | Pigment | Time (h) | Acid Rate (micromoles/h) |
|---|---|---|---|
| 1 | A-HR | 4 | 33 |
| 2 | A-HR | 18 | 15 |
| 3 | $BaSO_4$/A-HR | 19 | 34 |
| 4 | PEG600/A-HR | 17 | 36 |
| 5 | $BaSO_4$/PEG600/A-HR | 23 | 26 |

A-HR = Uncoated Anatase $TiO_2$, PEG = poly(glycol ether).

This example further demonstrates that uncoated Anatase $TiO_2$ is an effective promoter of photodegradation either alone or with other materials, e.g., $BaSO_4$, coated on the surface of the $TiO_2$ or with poly(ethylene glycol) added to the polymer.

EXAMPLE 6

Cellulose Acetate (DS/AGU) was dissolved in acetone containing 10.3% water to give an aqueous acetone solution of 26.3% solids. Fiber was spun by passing the CA solution through a 40 hole spinneret with a hole size of 0.0408 nm. The take-up speed of the fiber was 650 m/min and the spinning draw ratio was 0.89. This provided a fiber with a denier/filament of 3.18 as spun.

EXAMPLE 7

Preparation of a Cellulose Acetate Test Solution

A 350 g sample of cellulose acetate dissolved in acetone was diluted to 3500 mL with acetone and stirred until homogeneous. The acid number of this "stock solution" was 0.025. Evaporation of an aliquot to dryness gave cellulose acetate film having an inherent viscosity of 1.32 g/dL as measured in a 60/40 (wt/wt) phenol/tetrachloroethane solution).

EXAMPLE 8

Irradiation of Pigments to Demonstrate Photodegradation Activity

To a 300 mL PYREX round-bottomed flask containing a magnetic stirring bar and fitted with a condenser open to the atmosphere, was added 2.0 g of the pigment and 150 mL of the acetone solution of cellulose acetate described in Example 7. The flask was placed on a magnetic stirrer inside a Rayonet Photochemical Reactor fitted with 16 350 nm fluorescent lamps. Irradiation with stirring was done at 31° C. for various periods of time. Pigment was removed by centrifugation and the liquid was titrated to determine rates of formation of carboxylic acid degradation products.

EXAMPLE 9

Preparation of Barium Sulfate Coated Titanium Dioxide

TIOXIDE A-HR (20 g) (Titanium dioxide, Tioxide America, Inc.) was added to a solution of 2.0 g of barium chloride dihydrate in 25 mL of distilled, deionized water. The slurry was stirred for 0.5 h at 90° C. and was then evaporated to dryness with manual stirring. The white solid was suspended in 150 mL of methanol and stirred during addition of a solution consisting of 1.5 g of 97% conc. sulfuric acid in 25 mL of water. The slurry was filtered, washed with 65° C. water, re-slurried in 250 mL of 65° C. water, filtered, washed again with distilled water, and dried at 80° C. The title compound was provided (21 g) as a white solid containing 91.3 and 8.7 weight percent, respectively of titanium dioxide and barium sulfate.

EXAMPLES 10–17

Preparation of Other Salt Coated TIOXODE A-HR Pigments

Where the desired salts were soluble in water, the pigments were prepared by evaporating aqueous slurries of the salts and TIOXIDE A-HR to dryness with continuous stirring. Where the salts were insoluble, they were prepared by the general method described for barium sulfate coated sample (Example 9). See Table 2 below for a listing of salts prepared and data demonstrating their photodegradation activities. Note also that sodium phosphate is not a photoactive composition.

Test Methods

The screening test designed for determining pigment photoactivity is a modification of an isopropyl alcohol oxidation test. Absorption of the oxidizable substrate on the pigment surface is followed by hydrogen abstraction and oxygen addition initiated by positive holes (oxidizing sites) formed on the pigment surface by absorption of light at wavelengths below about 390 nm. Acidic oxidation products are formed from cellulose ester oxidation. Concentrations of these are determined by titration and serve as a measure of pigment activity.

Baseline data was generated for commercially available pigments for comparison with new systems designed for higher photooxidation activity. TIOXIDE A-HR gives a high initial rate of photooxidation (Table 1), but this rate falls from 33 during the first 4 hours to 15 for the first 18 hours and then drops to zero. It is probable that the pigment surface becomes coated with degradation products, thereby shielding it from fresh, unoxidized cellulose acetate. A reagent Anatase showed about 27% higher activity than A-HR after 17 hours irradiation. No data was obtained for longer irradiation times.

Several salt-coated Anatase pigments were prepared in an attempt to increase the activity, and to overcome the problem of pigment activity ceasing after a moderate period of cellulose ester oxidation (Table 2). Both goals were achieved. Both barium and calcium sulfates provided higher rates than uncoated A-HR, and showed no evidence of their oxidation activity stopping after up to 54 hours of irradiation. Calcium phosphate exhibited initial activity similar to A-HR, but continued to provide oxidation through 64 hours of exposure. Good initial activity was also observed for zinc sulfate and barium sulfate; these were not evaluated beyond 18 hours.

These results show that the modified titanias of the present invention exhibit superior catalytic activity for the photodegradation of oxidizable polymers, in particular, cellulose esters. Further details of such modified titanias can be found in U.S. Ser. No. 071889,326, Gether Irick, Jr., filed on May 27, 1992, incorporated herein by reference.

TABLE 1

Photoactivities of Anatase Pigments Containing No Salts

| Pigment | Irradiation Time, Hours | Acid Number | Acid Rate, Micromoles/h |
|---|---|---|---|
| TIOXIDE A-HR | 4 | 0.13 | 33 |
| | 18 | 0.27 | 15 |
| | 40 | 0.26 | 6 |
| Reagent Anatase | 17 | 0.32 | 19 |
| UNITANE OR-450 (Kemira, Inc.) | 43 | 0.05 | 0.5 |

Note-Acid number of the unirradiated cellulose acetate solution was 0.03.

TABLE 2

Photoactivity of Salt-Containing Anatase Pigments

| Salt[a] | Example no. | Irradiation Time, h | Acid Number* | Acid Rate μmoles/h |
|---|---|---|---|---|
| $BaSO_4$[b] | 4 | 18 | 0.44 | 24 |
| | 4 | 19 | 0.64 | 34 |
| $MgSO_4$ | 5 | 18 | 0.14 | 8 |
| $ZnSO_4$ | 6 | 18 | 0.23 | 13 |
| $CaSO_4$ | 7 | 18 | 0.39 | 22 |
| | 7 | 54 | 0.92 | 17 |
| $Na_2SO_4$ | 8 | 18 | 0.19 | 11 |
| $Ba_3(PO_4)_2$ | 9 | 18 | 0.21 | 12 |

TABLE 2-continued

Photoactivity of Salt-Containing Anatase Pigments

| Salt[a] | Example no. | Irradiation Time, h | Acid Number* | Acid Rate μmoles/h |
|---|---|---|---|---|
| $Ca_3(PO_4)_2$ | 10 | 18 | 0.23 | 13 |
| | 10 | 64 | 0.58 | 9 |
| $Na_3PO_4$ | 11 | 18 | 0.06 | 3 |

[a]Salt concentrations in these examples were 0.41 mmole/g of Anatase titanium dioxide.
[b]the 18 and 19 h runs were with duplicate preparations of coated pigments.
*Determined as mg KOH/g

We claim:

1. A cellulose ester fiber which comprises (a) a $C_1$–$C_{10}$ ester of cellulose having a degree of substitution per anhydroglycose unit (DS/AGU) of about 2.0 to about 2.2 and an inherent viscosity of about 0.2 to about 3.0 dL/g, as measured in a solution of 60/40 (wt/wt) phenol/tetrachloroethane, and (b) about 0.1–5 weight percent, based on the total weight of (a) and (b), of anatase titanium dioxide.

2. The cellulose ester fiber of claim 1, wherein said $C_1$–$C_{10}$ ester is selected from a list consisting of cellulose acetate, cellulose propionate, cellulose butyrate, cellulose acetate propionate, cellulose acetate butyrate, and cellulose propionate butyrate.

3. The cellulose ester fiber of claim 2, wherein said $C_1$–$C_{10}$ ester consists essentially of cellulose acetate.

4. The cellulose ester fiber of claim 1, further comprising one or more oxidizable promoter compounds.

5. The cellulose ester fiber of claim 4, wherein said oxidizable promoter compounds are selected from poly (ethylene glycol) and poly(tetramethylene glycol).

6. A cellulose ester fiber which comprises (a) a $C_1$–$C_{10}$ ester of cellulose having a degree of substitution per anhydroglycose unit (DS/AGU) of about 2.0 to about 2.2 and an inherent viscosity of about 0.2 to about 3.0 dL/g as measured in a solution of 60/40 (wt/wt) phenol/tetrachloroethane, and (b) about 0.1–5 weight percent, based on the total weight of (a) and (b), of uncoated anatase titanium dioxide.

7. The cellulose ester fiber of claim 6, wherein said $C_1$–$C_{10}$ ester is selected from a list consisting of cellulose acetate, cellulose propionate, cellulose butyrate, cellulose acetate propionate, cellulose acetate butyrate, and cellulose propionate butyrate.

8. The cellulose ester fiber of claim 7, wherein said $C_1$–$C_{10}$ ester consists essentially of cellulose acetate.

9. The cellulose ester fiber of claim 6, further characterized in that said Anatase titanium dioxide is coated onto an inert solid support.

10. The cellulose ester fiber of claim 9, further comprising one or more oxidizable promoter compounds.

11. The cellulose ester fiber of claim 10, wherein said oxidizable promoter compounds are selected from poly (ethylene glycol) and poly(tetramethylene glycol).

12. A cellulose ester fiber which comprises (a) a $C_1$–$C_{10}$ ester of cellulose having a degree of substitution per anhydroglycose unit (DS/AGU) of about 2.0 to about 2.2 and an inherent viscosity of about 0.2 to about 3.0 dL/g, as measured in a solution of 60/40 (wt/wt) phenol/tetrachloroethane;

(b) about 0.1–5 weight percent, based on the total weight of (a), of anatase titanium dioxide; and (c) one or more thermooxidation augmentation metal salts.

13. The cellulose ester fiber of claim 12, wherein said $C_1$–$C_{10}$ ester is selected from a list consisting of cellulose acetate, cellulose propionate, cellulose butyrate, cellulose acetate propionate, cellulose acetate butyrate, and cellulose propionate butyrate.

14. The cellulose ester fiber of claim 13, wherein said $C_1$–$C_{10}$ ester consists essentially of cellulose acetate.

15. The cellulose ester fiber of claim 12, wherein component (c) is selected from a list consisting of salts of Cu, Fe, Ni, Ca, Mg, and Ba.

16. The cellulose ester fiber of claim 15, wherein component (c) is present in a concentration of about 0.2 to about 1.0 weight percent based on the total weight of (a), (b), and (c).

17. The cellulose ester fiber of claim 12, further characterized in that components (b) and (c) are coated onto an inert solid support.

18. The cellulose ester fiber of claim 12, further comprising one or more oxidizable promoter compounds.

19. The cellulose ester fiber of claim 18, wherein said oxidizable promoter compounds are selected from poly (ethylene glycol) and poly(tetramethylene glycol).

20. A cellulose ester fiber which comprises (a) cellulose acetate having a degree of substitution per anhydroglycose unit (DS/AGU) of about 1.5 to about 2.5 and an inherent viscosity of about 0.2 to about 3.0 dL/g, as measured in a solution of 60/40 (wt/wt) phenol/tetracloroethane;

(b) about 0.1–5 weight percent, based on the total weight of (a), of Anatase titanium dioxide; and (c) calcium phosphate or calcium sulfate.

21. The fiber of claim 20, wherein component (c) is calcium phosphate or calcium sulfate.

22. The fiber of claim 20, further comprising one or more oxidizable promoter compounds.

23. The fiber of claim 22, wherein the oxidizable promoter compound is selected from poly(ethylene glycol) and poly (tetramethylene glycol.

* * * * *